United States Patent [19]

Caillet

[11] 4,445,640

[45] May 1, 1984

[54] HIGHWAY RAILWAY CROSSING AND CAP THEREFOR

[75] Inventor: Eugene Caillet, St. Marys, Ohio

[73] Assignee: The Goodyear Tire & Rubber Company, Akron, Ohio

[21] Appl. No.: 364,161

[22] Filed: Mar. 31, 1982

[51] Int. Cl.[3] ..... E01B 26/00; E01C 5/18; E01C 9/04

[52] U.S. Cl. ..... 238/8; 238/2; 238/9; 404/32; 404/47; 404/66

[58] Field of Search ..... 238/2, 8, 9; 404/32, 404/41, 47, 54, 64, 66

[56] References Cited

U.S. PATENT DOCUMENTS

| | | | |
|---|---|---|---|
| 2,828,080 | 3/1958 | Rennels | 404/32 X |
| 3,465,963 | 9/1969 | Caillet et al. | 238/8 |
| 3,713,368 | 1/1973 | McDowell et al. | 404/32 |
| 3,843,051 | 10/1974 | Whitlock | 238/8 |
| 3,894,686 | 7/1975 | Weinberg et al. | 404/32 X |
| 4,267,969 | 5/1981 | Hales et al. | 238/8 |
| 4,300,721 | 11/1981 | Rich | 238/8 X |
| 4,336,906 | 6/1982 | Limmergard | 238/8 |
| 4,365,743 | 12/1982 | Trickel et al. | 238/8 |

FOREIGN PATENT DOCUMENTS

| | | | |
|---|---|---|---|
| 171856 | 7/1952 | Austria | 238/8 |
| 179835 | 5/1922 | United Kingdom | 404/32 |

*Primary Examiner*—Robert B. Reeves
*Assistant Examiner*—Howard Beltran
*Attorney, Agent, or Firm*—R. D. Thompson

[57] ABSTRACT

A crossing construction for a railway including a plurality of spaced-apart cross-ties that support two parallel rails positioned thereon. The crossing includes a center pad of resilient rubber-like material positioned between the rails. A side pad of resilient rubber-like material is positioned on each side of the railway. Shims are used to position the uppermost surfaces of the center and side pads flush with the tops of the rails. On each side edge of the crossing there is provided a cap of resilient rubber-like material that includes a first leg that extends horizontally under a portion of each side pad and a second leg that extends vertically downwardly and covers the ends of the shims and a portion of the ends of the cross-ties the cap may include an extension pad and an L-shaped reinforcing member.

10 Claims, 3 Drawing Figures

HIGHWAY RAILWAY CROSSING AND CAP THEREFOR

This invention relates to highway railway crossing constructions and particularly to a cap of rubber-like resilient material for use in such a highway railway crossing construction.

Figure 1:
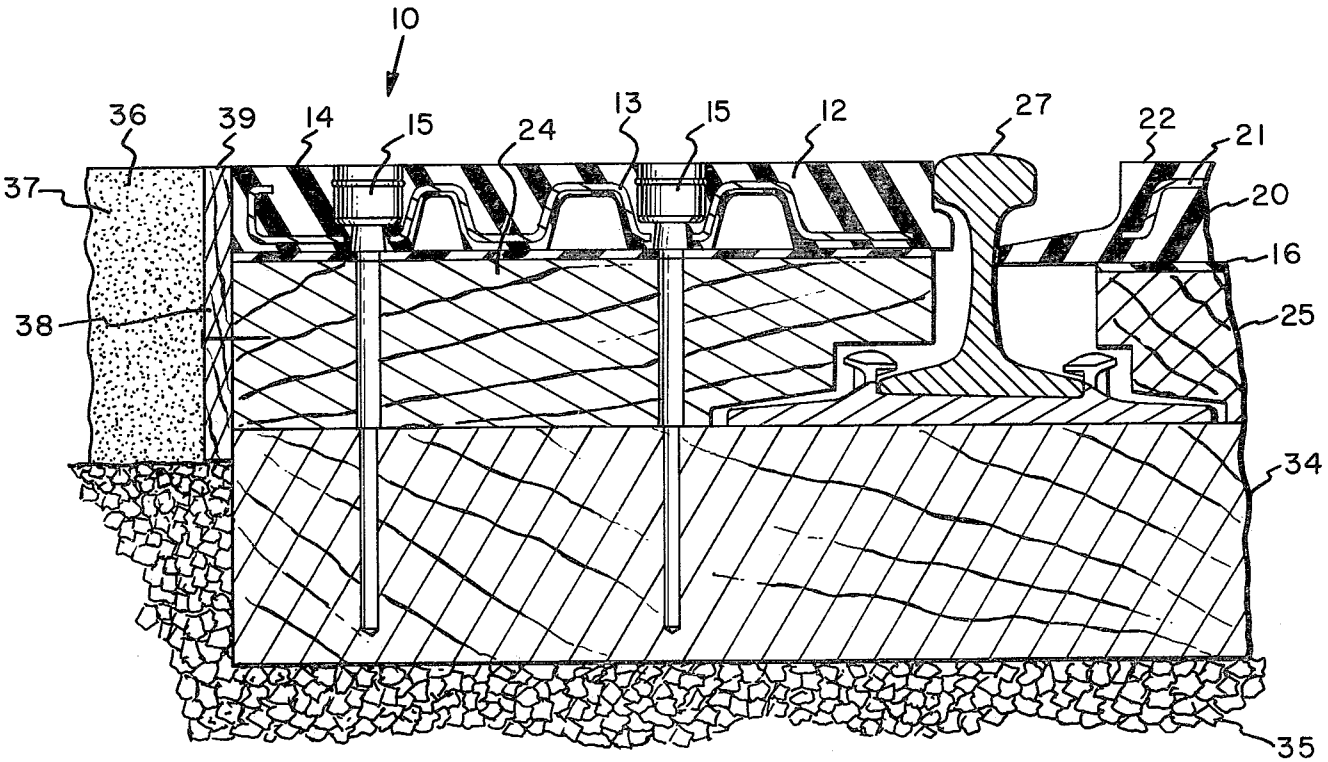
PRIOR ART FIG. 1
FIG. 1 is a cross-sectional, elevational view of a portion of a highway railway crossing, taken along a plane perpendicular to the direction of the railway.

In FIG. 1, there is illustrated a portion of a railway highway crossing 10 of known construction. Shown is one of two spaced-apart, in parallel relation, rails 27 of the railway. Rails 27 are supported by a plurality of cross-ties 34 that are spaced apart from one another in the direction of the railway. The cross-ties 34 are supported by a ballast layer 35 which in turn rests on the underlying earth (not shown). A center pad 20 of rubber-like resilient material reinforced by corrugated member 21 and of a width substantially equal to the space between the rails 27 is positioned therebetween.

The uppermost surface 22 of center pad 20 is arranged to be substantially flush with the uppermost surface of the rails 27 and in alignment with the uppermost surface of the highway 37 by forming the center pad of a thickness equal to the height of the rails 27 or by positioning shims 25 on each of the cross-ties 34 whereby the center pad 20 is supported in elevated relation to the cross-ties 34 with its uppermost surface 22 flush with the tops of the rails 27. An abrasion pad 16 of resilient, rubber-like material is preferably positioned between each center shim 25 and the center pad 20.

The rails 27 are located between a pair of side pads 12, only one of which is shown in each of the figure of the drawing, the other being substantially a mirror image of that shown. As in the case of the center pad 20, side pad 12 is of rubber-like resilient material that is reinforced by a corrugated member 13 that extends in the direction of the railway. Each side pad 12 is supported by a plurality of outside shims 24 positioned one each on the underlying cross-ties 34 such that its uppermost surface 14 is flush with the tops of the rails 27 and the highway 37. Each side pad 12 includes a plurality of openings 15 formed therein through which fasteners (not illustrated) may be positioned to join the side pad 12 to the cross-ties 34, for example, by means of bolts (not shown). Each center pad 20 is provided with similar openings (not shown) through which fasteners may be positioned.

Because the railway moves up and down as occasioned by a train traveling thereover, relative movement of the crossing to the rails or to the highway must be accommodated. In the construction shown in each of the accompanying figures, it is intended that the highway railway crossing structure including the shims and center pad 20 and side pad 12 move as a unit with the railway relative to the pavement 36 of the highway 37. Thus, a clear line of demarcation between the highway railway crossing and the highway 37 must be established and maintained.

As illustrated in FIG. 1, this is accomplished in railway highway crossings of known construction by provision of a wooden cap board 38, typically having a cross-sectional dimension of 1×8 or 1×10, or 2×8 or 2×10 inches. The wooden cap board 38 is positioned on edge so that its uppermost edge 39 is substantially flush with the uppermost surface 14 of the side pad 12 and highway 37 when neither the highway nor the railway is loaded. The wooden cap board 38 is maintained in its desired position by fastening it to the outside shims 24, for example, by means of nails or bolts. It has been found that the wooden cap board 38 often deteriorates before the remainder of the crossing and track supporting structure is in need of maintenance.

Figure 2:
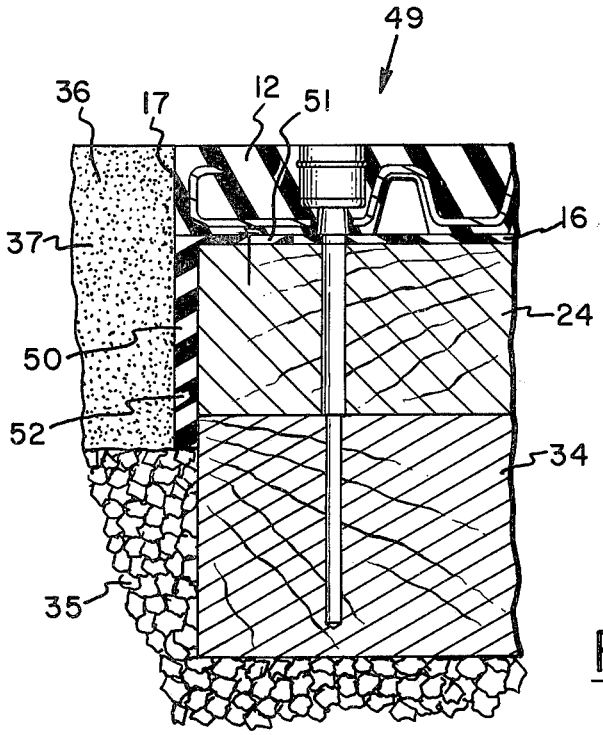
FIG. 2 is a cross-sectional, elevational view of a portion of a highway railway crossing according to an embodiment of the invention.

Referring now to FIG. 2, there is shown in cross-sectional elevation a portion of a railway highway crossing 49 according to an embodiment of the invention. No wooden cap board 38 is employed in the crossing 49. A cap 50 of rubber-like resilient material and the vertical outer edge 17 of the side pad 12 together provide a vertical plane of demarcation between the crossing and the adjacent pavement 36 of highway 37. The cap 50 is a bifurcated member that is elongated in the direction of the railway and has a first horizontally extending leg 51 that extends underneath a portion of the side pad 12 and is preferably secured in position by nailing to the outside shims 24. The horizontal first leg 51 serves to anchor the rubber cap 50 in position and also to isolate a portion of the side pad 12 from the underlying shims 24. A second vertically downwardly extending leg 52 of the cap 50 covers the ends of the outside shims 24 and preferably a portion of the underlying cross-ties 34. The cap 50 is continuous in the direction of the railway, thereby bridging the openings between adjacent outside shims 24 and preventing entry of paving material 36 of the highway 37 between the outside shims 24. Because the cap 50 is of a resilient rubber-like material, it can accommodate movement that occurs as a train rolls over the railway at the crossing without damage to itself or the adjoining pavement. The bottom edge of the second vertically extending leg 52 of the cap 50 preferably extends to the ballast 35. The first leg 51 and second leg 52 define between them a right angle.

Figure 3:
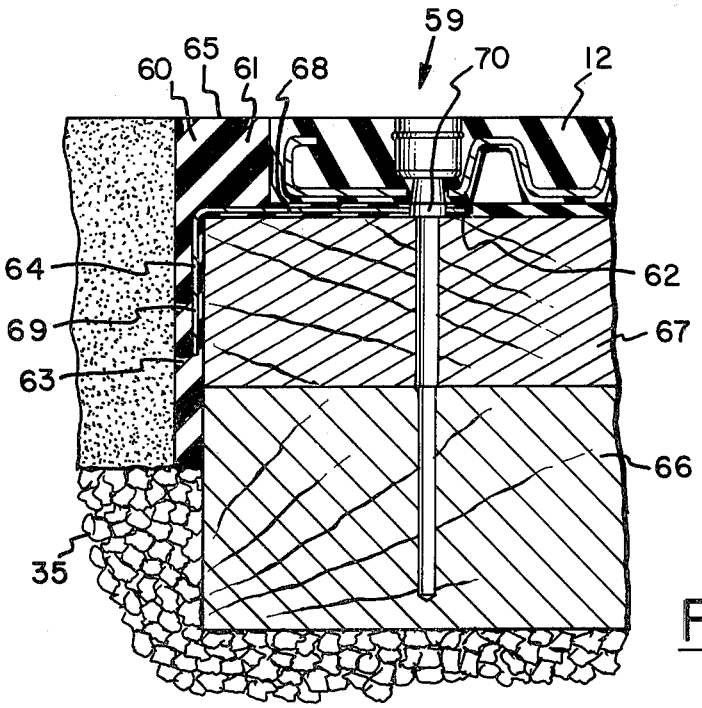
FIG. 3 is a cross-sectional, elevational view of a portion of a highway railway crossing construction according to another embodiment of the invention.

Referring now to FIG. 3, there is illustrated a second embodiment of a resilient reinforced cap 60 according to the invention. The remainder of the crossing structure 59 is similar to that shown and described in FIGS. 1 and 2. The elongated reinforced cap 60 of FIG. 3 includes an extension pad 61 the uppermost surface 65 of which forms a part of the highway traffic-bearing surface at the crossing. This reinforced cap 60 is utilized where a railway utilizing cross-ties 66 of greater length is encountered. The use of reinforced cap 60 permits the use of identical side pads 12 in crossings of differing widths. The reinforced cap 60 includes a first horizontally extending leg 62 that extends underneath a portion of the side pad 12. The first horizontally extending leg 62 of the reinforced cap 60 has openings 70 formed therein through which fasteners joining the side pad 12, the cross-ties 66, outside shims 67, and the cap 60 may be positioned. The second vertically downwardly extending leg 63 of the reinforced cap 60 extends over the ends of the outside shims 67 and a portion of the cross-ties 66 to the ballast 35. The reinforced cap 60 of FIG. 3 has disposed therein a reinforcing member 64 that extends in the direction of the railway. The reinforcing member 64 is formed of steel and includes a first horizontally disposed leg 68 approximately coextensive with that of the first leg 62 of the reinforced cap 60. Openings are formed in the horizontally disposed first leg 68 of the reinforcing member 64 through which fasteners (not illustrated) joining the cap 60, side pad 12, outside shims 67, and cross-ties 66 may be positioned. The metal reinforcing member 64 also includes a second vertically extending leg 69 that is disposed within the second vertically extending leg 63 of the reinforced cap member 60. The steel reinforcing member 64 is of an L-shaped cross-sectional configuration when viewed in a cross-section taken perpendicular to the direction of the railway. The reinforced cap 60 and the reinforcing member 64 therein are continuous in the direction of the railway. The second vertically extending leg 69 of reinforcing member 64 preferably extends downwardly over the ends of the outside shims 67 but is of a lesser extent than that of the resilient rubber-like material of the second leg 63 of reinforced cap 60.

What is claimed is:

1. A highway railway crossing having:

(a) a railway comprising:

(i) two spaced-apart indefinite length rails fastened to (ii) a plurality of cross-ties that are positioned perpendicular to the rails and spaced apart from one another along the indefinite length rails, the cross ties being supported by a (iii) ballast layer, and (b) a highway comprising a pavement extending at an angle to the railway and (c) a crossing surface comprising:

(i) a center pad of reinforced rubber-like resilient material positioned between the two rails and in alignment with the highway, (ii) a side pad positioned between the pavement and one of the rails and in alignment with the highway, (iii) a shim having an outside end positioned on the uppermost surface of each cross-tie, (iv) an abrasion pad of rubber-like resilient material positioned between each shim and the respective side pad, said crossing having the improvement which comprises the inclusion of (v) a cap of rubber-like resilient material having a first leg that extends horizontally between the side pad and its associated shims, and a second leg that extends vertically downwardly over the outside ends of the associated shims.

2. The highway railway crossing of claim 1, wherein the second leg of the cap covers the ends of the shims and a portion of the cross-ties.

3. The highway railway crossing of claim 1, wherein the cap further includes an extension pad whose uppermost surface is aligned with that of side pads and a reinforcing member disposed in the cap that extends along the indefinite length rails.

4. The highway railway crossing of claim 3, wherein the reinforcing member is of L-shaped cross-sectional configuration and has a first leg that extends horizontally under the associated side pad, the horizontally extending first leg including an opening in alignment with an opening through the associated side pad.

5. A crossing construction for a railway including a plurality of spaced-apart cross-ties and two parallel rails positioned thereon at right angles thereto comprising:

(a) a plurality of shims positioned one each on said cross-ties, each of said shims having an outside end, (b) a rubber-like resilient abrasion pad positioned on each shim, (c) a side pad of resilient rubber-like material having a reinforcing member therein that extends in a direction parallel to the rails, the side pad having openings formed therein through which fasteners joining the side pad and the cross-ties may be positioned, and (d) an integral cap of resilient rubber-like material having a first leg positioned between the side pad and its associated shims and a second leg covering the ends of the associated shims.

6. The crossing construction of claim 5, wherein the cap includes an extension pad whose uppermost surface is aligned with that of the side pad and an L-shaped metal reinforcing member disposed therein that extends along the indefinite length rails, the reinforcing member having a horizontally extending first leg including openings formed therein that are aligned with openings in the side pad and a vertically extending second leg covering the ends of the associated shims and a portion of the ends of the underlying cross-ties.

7. The crossing construction of claim 5, wherein the cap has a reinforcing member disposed within that extends along the indefinite length rails.

8. The crossing construction of claim 7, wherein the reinforcing member is of L-shaped cross-sectional configuration and includes a first horizontally extending leg including openings formed therein through which fasteners joining the cap and cross-ties may be positioned, the reinforcing member further including a second vertically extending leg covering the ends of the associated shims.

9. An integral cap for a railway crossing having a plurality of cross-ties, a plurality of shims, each having an outside end, positioned on the uppermost surface of each cross-tie, a side pad positioned on the uppermost surface of the shims, said cap being an elongated member formed of resilient rubber-like material having a first leg with openings formed therein and a second leg joined to the first leg at a right angle thereto, said cap being adapted for placement of the first leg between the pad and shims of the railway crossing with the second leg extending over the outermost end of the shims.

10. The cap of claim 9, further including an elongated metallic reinforcing member disposed within the first leg and the second leg.

* * * * *